United States Patent [19]

Derudder

[11] Patent Number: 4,915,138

[45] Date of Patent: Apr. 10, 1990

[54] INCREASED PICKING FREQUENCY OF PILE WIRE LOOMS

[75] Inventor: Carlos Derudder, Heule, Belgium

[73] Assignee: N.V. Michel van de Wiele, Kortrijk-Marke, Belgium

[21] Appl. No.: 233,459

[22] Filed: Aug. 18, 1988

[30] Foreign Application Priority Data

Aug. 27, 1987 [BE] Belgium ..... 8700952

[51] Int. Cl.[4] ..... D03D 39/14

[52] U.S. Cl. ..... 139/40; 139/42

[58] Field of Search ..... 139/39, 40, 41, 42, 139/444, 445, 116.6

[56] References Cited

U.S. PATENT DOCUMENTS

| | | | |
|---|---|---|---|
| 1,840,856 | 1/1932 | Stone | 139/40 |
| 3,008,494 | 11/1961 | Smiley | 139/42 |
| 3,149,647 | 9/1964 | Park et al. . | |
| 3,613,740 | 10/1971 | Geiger | 139/445 |

FOREIGN PATENT DOCUMENTS

| | | |
|---|---|---|
| 893051 | 11/1982 | Belgium . |
| 1137193 | 5/1975 | France . |
| 1295076 | 11/1972 | United Kingdom . |

*Primary Examiner*—Andrew M. Falik

*Attorney, Agent, or Firm*—James Creighton Wray

[57] ABSTRACT

Method of weaving pile fabrics by means of pile wire looms, wherein the fabric has a pile loop every n wefts, n being greater than or equal to 2, and wherein each of the pile wires is inserted in an insertion cycle which takes place during one weft cycle and are each extracted, one after the other, in an extraction cycle which takes place over n successive weft cycles. Apparatus for applying this method comprises at least two extraction and one insertion carriage. In addition, the apparatus has a transfer device which consists essentially of a fixed pile wire bar and a movable pile wire bar. The two pile wire bars are provided on their mutually facing longitudinal sides with a guide track over which the pile wires make their extraction movement and insertion movement.

16 Claims, 6 Drawing Sheets

FIG. 7d'e'

INCREASED PICKING FREQUENCY OF PILE WIRE LOOMS

BACKGROUND OF THE INVENTION

The present invention relates to a method and an apparatus which enable the picking frequency of pile wire looms to be increased. The present invention relates more particularly to looms for weaving fabrics which have a pile loop every n wefts, n being greater than or equal to two.

Pile wire looms are provided with one or more devices which during weaving insert pile wires into the shed in such a manner that the wires come to lie on the ground texture and that the pile warp threads forming the pile pass over the pile wires and thus form pile loops. The same devices withdraw the inserted wires out of the fabric formed, so that pile loops or tufts are left behind on the fabric. If the pile wires are provided with small cutters at their ends, the loops are cut through so that an upstanding pile is left on the fabric.

In the weaving of fabrics having a minimum of one pile loop every n wefts, one pile wire must be inserted into the shed every n wefts. For the two-weft V weave, for example, one pile wire must be inserted every two wefts. The classic pile wire cycle in the weaving of a fabric with a weave of this kind is as follows. A pile wire is extracted during the weft cycle m and inserted during the following weft cycle m+1. For this purpose the pile wire insertion and extraction device is provided with one pile wire carriage, which during the weft cycle m extracts a pile wire and during the following weft cycle m+1 inserts the same pile wire.

The picking frequency or speed of revolution of pile wire looms of this kind is limited by the heating-up of the pile wires during their extraction. The heat produced is caused on the one hand by friction between the pile wire and the pile threads surrounding it, and on the other hand, in the case of cutter pile wires, through the cutting of the pile loops. Particularly in the latter case, the heat produced is difficult to dissipate because it is highly localized, occurring at the cutting edge of the cutter. The local temperature can then easily rise above the discoloration point of the pile threads, so that they are damaged. This is naturally unacceptable, so that the speed of extraction of the pile wires must be kept within certain limits. Another hindrance is the so-called "transfer" time. The "transfer" time is the time required between weft cycle m and weft cycle m+1, around the beating-up by the reed, for re-orienting the pile wire extracted during the weft cycle m to bring it from its extraction position to its position for insertion into the shed. The extraction time is thus shorter than the time between two operations of the reed. It is thus clear that, in view of the limited extraction time and the limited speed of extraction, the picking frequency is also restricted and that the greater the width of the fabric, or the distance over which the pile wires have to be extracted, the lower the picking frequency will be.

The use of lubricants, the blowing of cold air over the pile wires, and the increasing of the number of pile wires in the fabric—the so-called pile wire packet—are known means for overcoming this problem, but these means bring about only a very slight reduction of the limitation of extraction speed.

In BE 893,051 a solution to this problem is disclosed, consisting of a method whereby two or more pile wires are extracted at the same time from the fabric. The simultaneous extraction of pile wires, however, gives rise to a number of fundamental problems and disadvantages. If a plurality of pile wires have to be extracted simultaneously on one side of a loom, a complicated extraction, transfer and insertion device is necessary. No device of this kind is known up to the present time, and the publication mentioned is also vague on this subject. The publication mentioned in fact describes only one valid device for applying this method. This device consists of two pile wire operating devices, which are installed separately one on each side of the loom. However, this arrangement has the great disadvantage of requiring a width three to four times that of the maximum width of fabric, which is extremely space consuming. In addition, this arrangement has the disadvantage that provision must be made to coordinate the movements of the two pile wire operating devices. This entails the incidental provision of mechanical transmission or electronic control for both the pile wire operating devices. The publication mentioned suggests that this arrangement makes it possible for a pile wire to be extracted over three picking periods, so that the pile wires are thus extracted at one third the speed reached with the classic method. This assertion is however incorrect, because it does not take into account the time needed for bringing the extracted pile wire from its extraction position to its insertion position.

SUMMARY OF THE INVENTION

The present invention seeks to provide a solution which enables the picking frequency to be considerably increased in the weaving of fabrics having a pile loop every 2 to n wefts by means of pile wire looms, without a plurality of pile wires being extracted simultaneously. The advantage of an increased picking frequency is obvious, since the maximum picking frequency of a loom is directly proportional to its performance. A higher maximum picking frequency thus means higher performance.

The invention consists of a method and an apparatus for applying this method.

The method according to the invention for the weaving of pile fabrics by means of pile wire looms, wherein the fabric has a pile loop every n wefts, n being greater than or equal to 2, and wherein the pile wires are each inserted in an insertion cycle which occurs during one weft cycle and are each extracted, one after the other, in an extraction cycle, is characterized in that an extraction cycle takes place over two to n successive weft cycles, and that the insertion cycle of one pile wire takes place during one of the n weft cycles of the extraction cycle of another pile wire.

The method according to the invention has the advantage that the pile wires are extracted over a time coinciding with a plurality of weft cycles, without any pile wires having to be extracted simultaneously. Consequently, the speed of extraction of the pile wire is reduced in relation to the operating speed of the loom, and the disadvantages and problems associated with the simultaneous extraction of pile wires is avoided. The method according to the invention provides maximum results as the extraction cycles follow one another instantaneously and each of them takes place over n weft cycles.

The apparatus according to the invention for the insertion and extraction of the pile wires in the weaving of pile fabrics by means of a pile wire loom, wherein the fabric has a pile loop every n wefts, n being greater than or equal to two, consisting of means for guiding the pile wires during their insertion and extraction movements and of pile wire carriages which move to-and-fro along the guide means and insert or extract the pile wires, is characterized in that the pile wire carriages comprise at least one extraction carriage, which makes the extraction movement over two to n successive weft cycles, and at least one insertion carriage which makes the insertion movement over one weft cycle and during the extraction cycle.

The apparatus according to the invention for the insertion and extraction of the pile wires in the weaving of pile fabrics by means of a pile wire loom, consisting of means for guiding the pile wires during their insertion and extraction movements and of one or more pile wire carriages which move to-and-fro along the guide means and insert or extract the pile wires, is characterized in that the guide means consist of a fixed guide track which is situated at the extraction position, coinciding with the direction of extraction of the pile wires, and of a movable guide track which on the one hand assumes an insertion position with a determined pile wire insertion direction, and on the other hand assumes an extraction position coinciding with the direction of extraction of the pile wires.

Because of the special character of the apparatus according to the invention, particularly in the light of the movement of the extraction carriages, the invention should also provide a novel appropriate pile wire gripping mechanism which grips the pile wires at the appropriate moment, carries them with the pile wire carriages and releases them again, and which permits the return movement of the pile wire carriages. Known devices in pile wire carriages used up to the present time are not suitable for the purpose because they were not designed to meet these requirements. The invention thus also seeks to solve this problem.

The apparatus according to the invention for the insertion and extraction of pile wires in the weaving of pile or nap fabrics by means of a pile wire loom, consisting of means for guiding the pile wires during their insertion and extraction movements and of one or more pile wire carriages which move to-and-fro along the guide means and insert and extract the pile wires, is also characterized in that the pile wire carriages are provided with a gripper which is mounted for sliding on the pile wire carriage, which closes during its movement towards the guide means and in the closed position can grip a pile wire, and which opens during its movement away from the guide means.

Further details of the present invention will emerge from the following description of the method and of a preferred form of construction of the apparatus according to the invention, which is given as an example without having a limitative character.

BRIEF DESCRIPTION OF THE DRAWINGS

This description refers to the accompanying drawings, in which.

Figure 3:
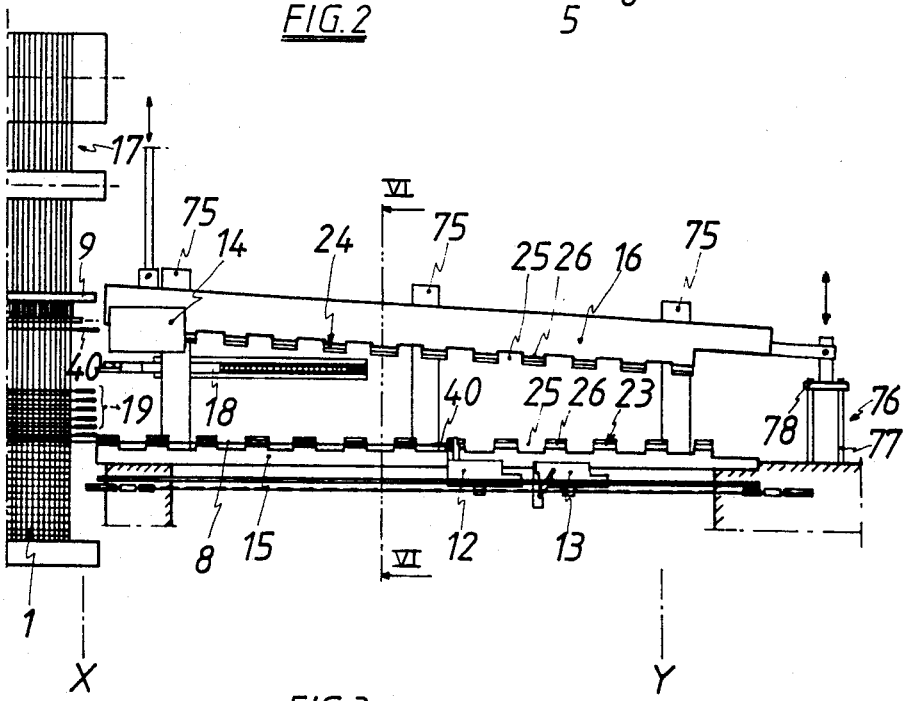
FIG. 3 is a schematic top plan view of part of a pile wire loom provided with an apparatus according to the invention.
Figure 5:
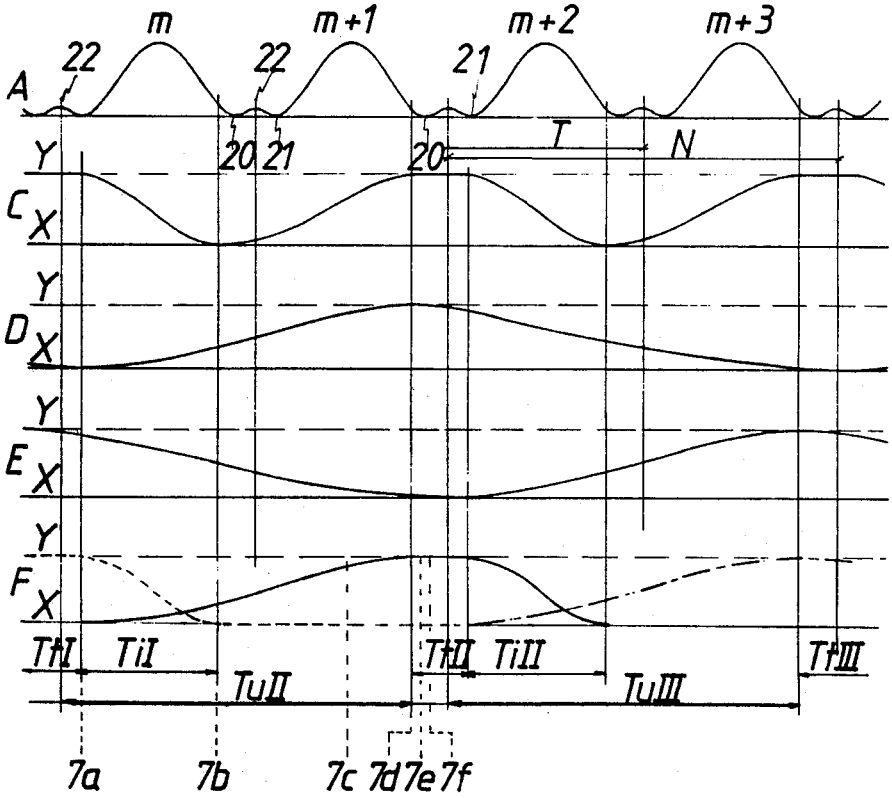
FIG. 5 is a time-displacement diagram of the pile wire cycle according to the invention, with the same weft period T, for a two-weft V weave, wherein the movement of the pile wire carriages is indicated.

FIGS. *7a* to *7f* are schematic sections on the line VI—VI in FIG. 3, and *7a–7d–e* are top plan views of both pile wire bars in the different positions indicated in FIG. 5.

Figure 8:
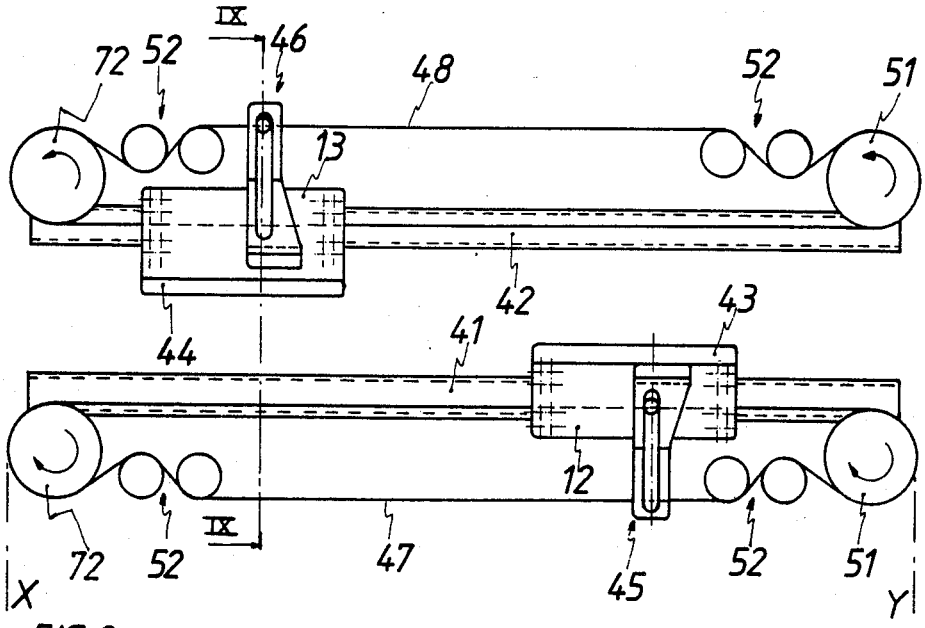

FIG. 8 is a front view of the extraction carriages and their drive.

Figure 9:
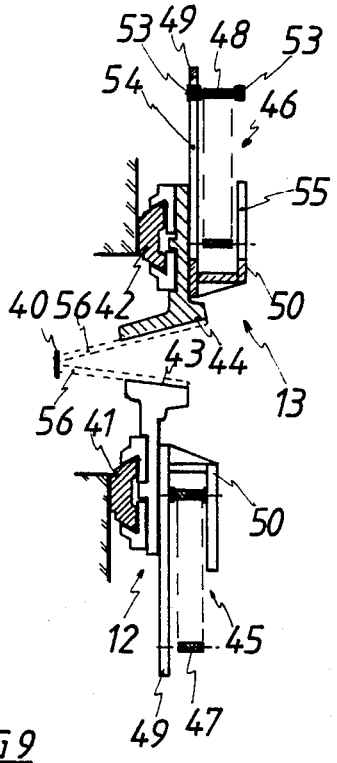

FIG. 9 is a section on the line IX—IX in FIG. 8, with the position of the grippers indicated schematically.

Figure 10:
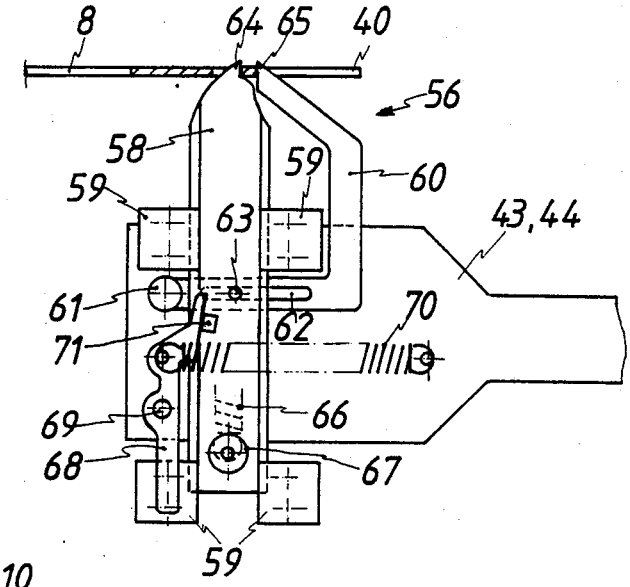

FIG. 10 is a top plan view of the gripper in its front position.

Figure 11:
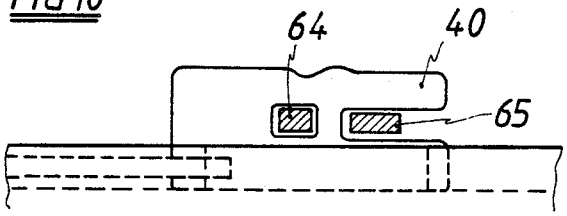

FIG. 11 is a side view of a pile wire head in the guide track in the fixed pile wire bar, with the two jaws of the gripper of the extraction carriages, in section.

Figure 12:
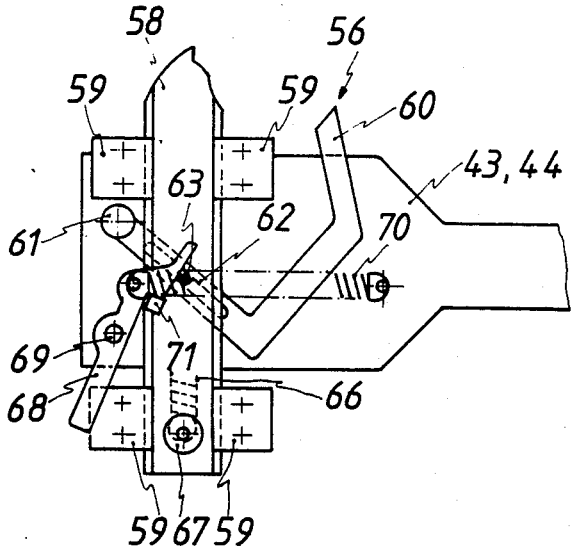

FIG. 12 is a top plan view of the gripper of the extension carriages, in the rear position.

DETAILED DESCRIPTION OF THE DRAWINGS

The pile wire weaving process will be explained with reference to FIG. 1, in which a fabric 1 with a two-weft V weave is shown. The weave is here constructed with three pile warp threads 2, 3 and 4, a slack warp 5, a tension warp 6, and weft threads 7. In a two-weft V weave a pile wire 8 must be inserted into the shed every two weft threads 7. The pile warp thread 2 which at the weft 7' was above the inserted pile wire 8' forms a loop 10 after beating up by the reed 9. If the pile wires 8 are provided at their end with a small cutter, the loops 10 are cut open as the pile wires 8 are extracted, so that a pile 11 is formed.

Figure 2:
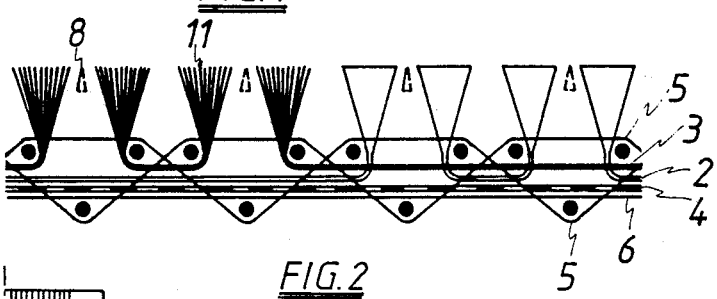
FIG. 2 illustrates a three-weft weave.

In a three-weft weave, of which an example is shown in FIG. 2, a pile wire 8 must be inserted every three wefts. The positions of the pile wires 8 before their extraction movement are indicated in broken lines in FIG. 2.

The apparatus according to the invention which is shown in FIG. 3 comprises two extraction carriages 12 and 13, one insertion carriage 14, and a transfer device consisting, among other parts, of a fixed pile wire bar 15, over which the pile wires 8 are extracted, and a movable pile wire bar 16 over which the pile wires 8 are inserted. In addition, the pile warp threads 17, the reed 9 in its rear position, a weft insertion device 18, the pile wire packet 19, that is to say the set of pile wires penetrating into the finished fabric, and a part of the finished fabric 1 are shown.

Figure 1:
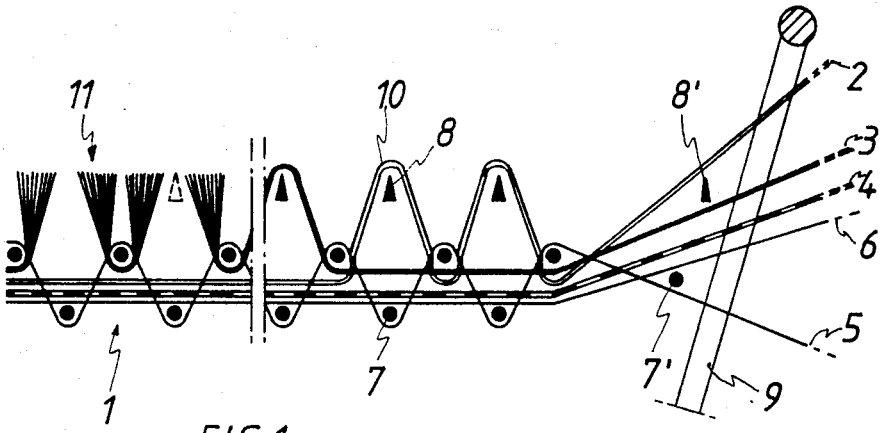
FIG. 1 illustrates schematically the pile wire weaving process, showing a two-weft V weave.

The movement of the extraction and insertion carriages 12, 13 and 14 respectively in the apparatus and the method according to the invention is illustrated in FIG. 5 for a two-weft V weave (see FIG. 1). For the purpose of comparison, however, an explanation will first be given of FIG. 4, which illustrates the movement of the pile wire carriages for the same two-weft V weave with the classic method and apparatus.

Figure 4:
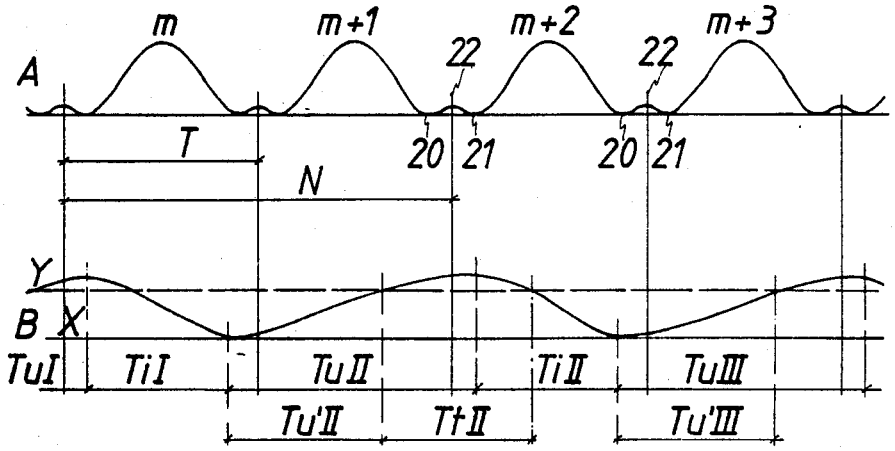
FIG. 4 is a time-displacement diagram of the classic pile wire cycle with a weft period T for a two-weft weave.

The horizontal axis in both FIGS. 4 and 5 is the time axis, and the vertical axis is the displacement axis. The curves A in FIGS. 4 and 5 show the movement of the reed 9. The reed 9 here makes a double beating-up movement 20, 21. The time elapsing between two first beating-up movements 20 coincides with the time between two picks or with the weft period T. Said weft period T was assumed to be the same for both FIG. 4 and FIG. 5 and indicated as the time elapsing between the lines 22 lying in each case between the first and second beating-up movements 20 and 21 respectively. A weft cycle is by definition the cycle beginning and ending with a beating-up movement of the reed, during which a weft thread is inserted into the shed and beaten up against the fabric formed. The lines 22 thus also indicate the beginning and end of the weft cycles. In FIGS. 4 and 5 four arbitrary successive weft cycles m, m+1, m+2, m+3 are shown in each case. The horizontal line X indicates the position in which the head 40 of a pile wire 8 is situated when the pile wire 8 is woven into the fabric 1, and coincides with the position of the insertion carriage 14 at the end of the insertion movement and with the position of one extraction carriage 12 or 13 at the moment when the latter grips the head 40 of a pile wire 8 in order to extract it (see also FIG. 3). The horizontal line Y indicates on the one hand the position in which the head 40 of a pile wire 8 is situated at the moment when said pile wire 8 has been completely extracted and at the moment when said pile wire 8 is situated exactly in front of the heads 40 of the interwoven set of pile wires 19, before or during the insertion movement, and thus on the other hand indicates the coinciding positions of an extraction carriage 12 or 13 and of the insertion carriage 14 respectively.

Curve B in FIG. 4 shows the displacement of the single pile wire carriage, which thus serves both as extraction carriage and as insertion carriage, and therefore also the displacement of the successive pile wires in the case of the classic method and apparatus. The pile wire II for example moves, together with the pile wire carriage, over a time Tu II in the extraction direction, from X to Y, and over a time Ti II in the insertion direction, from Y to X. It is then the turn of the pile wire III to be extracted. In the case of a two-weft weave one pile wire must be extracted and inserted every two wefts. In the classic method the sum of Tu II and Ti II is equal to the time N of n weft cycles, that is to say here two weft cycles. Since there is only one pile wire carriage, a part of the total time Tu II+Ti II is spent on the positioning movement, the "transfer" time Tt II, during which the pile wire II is moved from its extraction position to its insertion position. A pile wire thus has to be extracted during the far shorter time Tu'. With an operating speed of the loom of 1 revolution per minute, in this classic process a pile wire is extracted at an average speed of about 0.085 meters per second with a fabric width of 2 meters.

In the method according to the invention practically the total time coinciding with n weft cycles can be used for the pile wire extraction cycle. For a fabric which has one pile loop every n wefts there can for example be two extraction carriages 12 and 13 (FIG. 3) and for example one insertion carriage 14 (FIG. 3). FIG. 5 shows the movement of these pile wire carriages 12, 13 and 14 for the weaving of a two-weft weave. Curve C shows the displacement of the insertion carriage 14, which over a time Ti within one weft cycle makes the insertion movement from Y to X and returns during the next weft cycle, from X to Y, and then during a time Tt, during which a pile wire is moved from its extraction position to its insertion position, remains stationary in the position Y or makes a "overstroke" before again making an insertion movement.

The curves D and E show the displacement of the extraction carriages 12 and 13. An extraction carriage moves during n weft cycles, that is to say here during two weft cycles, from X to Y—the extraction movement—and during the next n weft cycles, that is to say here during two weft cycles, moves back from Y to X. The extraction movement from X to Y, however, takes place during a somewhat shorter time than the return movement because of the fact that the transfer movement—the displacement from the extraction position to the insertion position—of a pile wire must follow the extraction movement and also takes a certain time. Curve D here follows an opposite path to that of curve E.

The curve F shows the displacement of the pile wires during their extraction, transfer and insertion cycles. The cycles of the pile wire II are shown in solid lines and those of the preceding and following pile wires, I and III respectively, in broken lines. The curve F is a combination of the curves C, D and E. During the time Tu II, which is practically equal to the time N of n wefts, that is to say here 2 wefts, the pile wire II is extracted by the extraction carriage of curve D; during the time Tt II it is moved by the transfer device to its insertion position, and during the time Ti II it is inserted by the insertion carriage. As can be seen from comparison between FIGS. 4 and 5, the pile wire is extracted from the fabric over a far longer time. With the same distance X–Y and the same picking frequency f, this thus results in a substantially lower extraction speed. Since in the apparatus according to the invention the extraction and insertion movements of the pile wires are made with the aid of different pile wire carriages, the transfer time Tt can be far shorter than with the classic apparatus, and the extraction movement of a pile wire can already start before the transfer movement of the previous pile wire has been completed. While the extraction time Tu' in the classic method is shorter than the time of one-weft cycle, the time Tu in the method according to the invention is practically equal to that of n weft cycles, that is to say here two weft cycles. As a comparison, with a loom speed of 1 revolution per minute a pile wire in the case of the method according to the invention, which is shown in FIG. 5, is extracted at an average speed of about 0.025 meter per second with a fabric width of 2 meters. A pile wire loom working in accordance with the method of the invention and/or provided with an apparatus according to the invention can thus operate at practically 3 to 4 times the speed of a classic pile wire loom before the critical extraction speed is reached, so that the production capacity is increased in proportion.

The insertion cycle for a pile wire can take place during the first weft cycle which follows the n weft cycles of the extraction cycle of the same pile wire, as illustrated in FIG. 5, where pile wire II is extracted over weft cycles m and m+1 and inserted over m+2. The insertion cycle of a pile wire may however also take place during any of the n weft cycles which follow the extraction cycle of the same pile wire. Thus, the pile wire II in FIG. 5 can also be inserted over weft m+3, if the movement of the insertion carriage is adapted. A method in which a certain pile wire is only inserted four, five or more weft cycles later is also included in the method according to the invention. For this last possibility, however, a pause must be provided for the pile wires between their extraction and insertion movements. For a three-weft weave the extraction cycle for a pile wire may take place over two or three wefts, and the insertion cycle for a pile wire may take place during the three weft cycles and immediately following the extraction cycle or later. For some of these arrangements more than two extraction carriages and more than one insertion carriage may then be necessary. The delaying of the insertion cycle provides the advantage that the pile wires have time to cool outside the fabric after they have been heated by friction with the pile threads during the extraction cycle.

Figure 6:
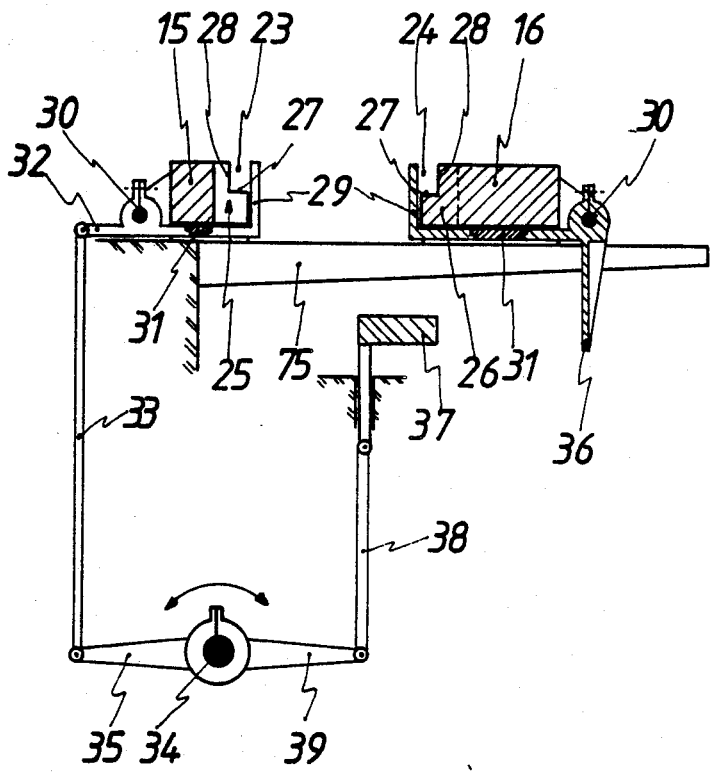
FIG. 6 is a section of both pile wire bars, taken on the line VI—VI in FIG. 3, the drive for the hooks being shown schematically.

In addition to the number of pile wire carriages, the transfer device of the apparatus according to the invention is of importance. The transfer device consists essentially of a fixed pile wire bar 15 and a movable pile wire bar 16 (FIGS. 3, 6 and 7). The two pile wire bars 15 and 16 are provided on their mutually facing longitudinal sides with a guide track 23 and 24 respectively, over which the pile wires make their extraction movement and insertion movement respectively. The guide tracks 23 and 24 are so constructed that they fit one in the other and form one continuous guide track when the two pile wire bars 15 and 16 come to lie with their longitudinal sides, in which the guide tracks are formed, one against the other. The pile wire bars 15 and 16 are for this purpose preferably provided on their mutually facing longitudinal sides with a plurality of cutouts 25 disposed at fixed distances from one another. The resulting projections 26 have a smaller height than those of the pile wire bars 15, 16, so that the top surfaces of the projections 26 form the bottom supporting surface 27 of the guide track and the upstanding portions form the fixed side wall 28 of the guide track (FIG. 6). The width of a cutout 25 must be slightly greater than the width of the projection 26 lying opposite, so that the two pile wire bars 15 and 16, when correctly positioned, can fit with their respective cutouts 25 and projections 26 in one another when the pile wire bars are placed one against the other. The supporting surfaces 27 of the projections 26 of both the fixed pile wire bar 15 and the movable pile wire bar 16 then come to lie at the same height and form a practically continuous supporting surface.

In the transfer device of the apparatus according to the invention the second side surface of the guide tracks 23 and 24 is displaceable on the mutually facing side of the pile wire bars. This second side surface consists of hooks 29 installed at the height of each projection 26 in such a manner that they can pivot away and having one end rotatable about a pin 30 disposed behind the pile wire bars 15 and 16. In the upwardly pivoted position (FIG. 6) one leg of the hook 29 lies against the lower face of the pile wire bar 15 or 16 and the other leg of the hook 29 lies upright along the projections 26 of the pile wire bar 15 or 16 and thus forms the second side wall of the guide tracks 23 and 24. When the hooks are pivoted away in the downward direction, as shown for example in FIG. 7*b*, the second side wall pivots away from the guide tracks 23 and 24, so that the pile wire which at that moment is situated in the guide track 23 or 24 can be pushed horizontally out of the guide track 23 or 24, away from the pile wire bar 15 or 16.

The drive for the movement of the hooks can be achieved in different manners. In FIG. 6 the hooks 29 of the fixed pile wire bar 15 are provided with a lever 32 projecting behind the pin 30. A rod 33 is pivotally connected to the lever. The same rod 33 is pivotally connected by its bottom end to a lever 35 mounted fast on a shaft 34. The shaft 34 is driven by an oscillating drive, such as a crank mechanism or a cam and follower mechanism, in such a manner that the hooks 29 of the fixed pile wire bar 15 pivot down at the appropriate moment. The hooks 29 of the movable pile wire bar are provided with a lever 36, which is directed downwards under the pin 30 and which strikes against a movable stop 37 when the movable pile wire bar moves towards the fixed pile wire bar 15, so that the hooks 29 pivot downwards during this movement. The hooks 29 of the movable pile wire bar 16 are also provided with springs which pivot the hooks 29 back in the upward direction when their levers 36 are free. For this purpose the stop 37 can be moved away at the appropriate moment, for example with the aid of a rod 38 and a lever 39, by means of the same shaft 34.

The installation and the driving of the movable pile wire bar 16 may also be achieved in different ways, for example as illustrated in FIGS. 3 and 6. The movable pile wire bar 16 rests on a number of supports 75 having a practically horizontal top surface. The supports 75 allow the movable pile wire bar 16 to be moved between its insertion position (see also FIGS. 7*a* and 7*b*) and its extraction position (see also FIGS. 7*d* and 7*e*). The rear end of the movable pile wire bar 16 is pivotally connected to a straight guide 76 which is disposed transversely to the fixed pile wire bar 15 and which consists for example of a number of fixed guide bars 77 over which a sliding plate 78 can be moved with the aid of ball bearing bushes, so that the position of the movable pile wire bar 16 in the longitudinal direction is fixed in such a manner that the projections 26 of the movable pile wire bar 16, in the extended position, fit into the cutouts 25 in the fixed pile wire bar 15. The movable pile wire bar 16 is then driven by rods which act on its ends, and which are driven by a crank or cam mechanism, in such a manner that the movable pile wire bar 16 makes the desired movement in coordination with the weft cycles and with the movement of the hooks 29 on the pile wire bars 15 and 16.

The coordinated movements are illustrated in FIG. 7, which refers to FIG. 5. In FIG. 7*a* the movable pile wire bar 16 is situated in its insertion position, the pile wire I is ready for insertion, and the pile wire II has not yet commenced its extraction movement (see also FIG. 5). The hooks 29 of the two pile wire bars 15 and 16 have been pivoted upwards and close the two guide tracks 23 and 24 respectively at their sides.

Figure 7A:
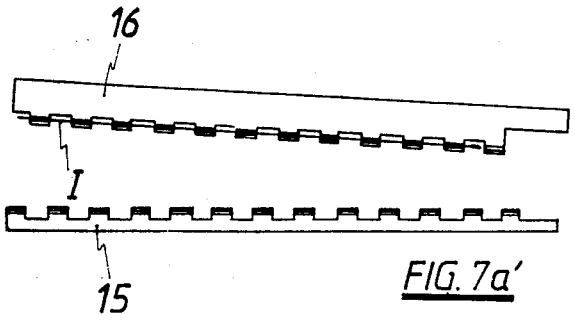
Figure 7A:
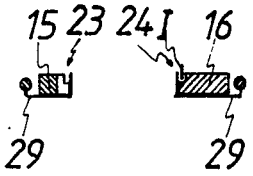
Figure 7B:
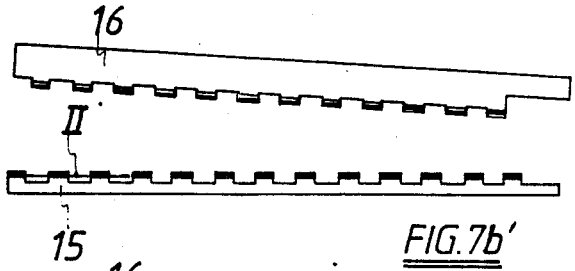
Figure 7B:
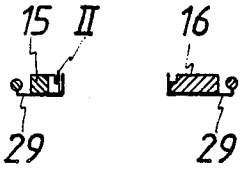

In FIG. 7*b* the movable pile wire bar 16 is still in its insertion position, the pile wire I is completely inserted, and the pile wire II is partly extracted.

Figure 7C:
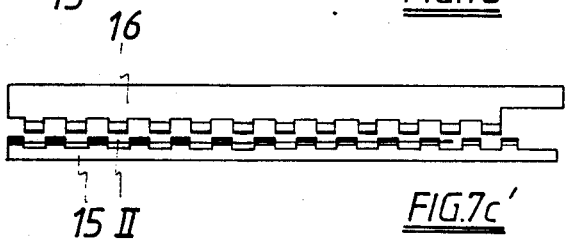
Figure 7C:
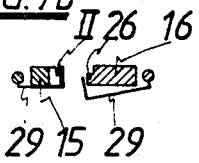
Figure 7D:
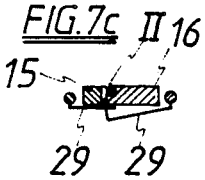

In FIG. 7*c* the movable pile wire bar 16 moves towards the fixed pile wire bar 15 and the hooks 29 of the movable pile wire bar 16 are pivoted downwards, so that the projections 26 of the movable pile wire bar 16 can be pushed under the pile wire II which is being extracted and into the cutouts in the fixed pile wire bar 15 (FIG. 7*d*).

Figure 7E:
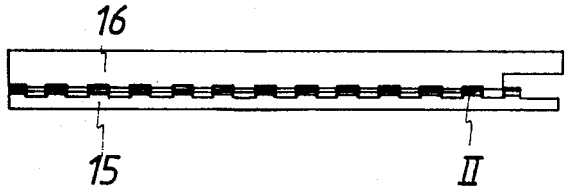
Figure 7E:
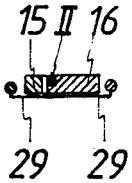
Figure 7F:
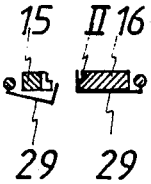

In FIG. 7*d* the extraction movement of the pile wire II is finished. The hooks 29 of the movable pile wire bar 16 are pivoted upwards again, so that the pile wire II is supported on both sides both by the hooks 29 of the fixed pile wire bar 15 and movable pile wire bar 16 and by the pile wire bars 15 and 16 themselves (FIG. 7*e*). The hooks 29 of the fixed pile wire bar 15 are pivoted downwards (FIG. 7*f*), so that the movable pile wire bar 16 can be pushed back to its insertion position. The pile wire II is thus taken away from the movable pile wire bar 16 by means of the hooks 29, and in this way, resting in the guide track 24, reaches its insertion position (see FIG. 7*a*). As soon as the movable pile wire bar 16 is free of the fixed pile wire bar 15, a new extraction movement can take place with the aid of the latter.

A possible arrangement and drive for the extraction carriages 12 and 13 will now be explained with the aid of FIGS. 8 and 9. Each extraction carriage 12, 13 slides over a straight guide 41 and 42 respectively, disposed parallel to the fixed pile wire bar 15. The straight guide 41 is disposed under the straight guide 42. An extraction carriage 12 or 13 consists not only of the sectional member and rollers mounted on the straight guide 41 or 42, but also of a gripper base plate 43 and 44 respectively and a bow 45 and 46 respectively to which the drive chain 47 and 48 respectively of each extraction carriage 12 and 13 is attached. The extraction carriages 12 and 13 are so positioned that their gripper base plate 43 and 44 respectively face one another. The gripper base plates are inclined in such a manner that lines extending them to the height of the position of a pile wire head 40 would intersect in the guide track 23 in the fixed pile wire bar 15. The bows 45, 46 are substantially U-shaped and have one long and one short leg 49 and 50 respectively, and they are fastened on the extraction carriages 12 and 13 in such a manner that their bases face one another.

A closed drive chain 47 and 48 respectively is provided along each of the straight guides 41 and 42. Each drive chain 47 and 48 extends around a return roller 51, a driving sprocket wheel 72, and a number of chain tensioners 52, and these drive chains are driven in opposite directions. The positioning of the chain tensioners 52 and the direction of rotation of each drive chain 47 and 48 are such that the path to be travelled by a drive chain 47 and 48 between the two return rollers 51 is shorter in the pile wire extraction direction than in the opposite direction. Each drive chain 47 and 48 extending between two legs 49 and 50 of the bows 45 and 46 is provided in a determined position of both sides with small transmission rollers 53. Each of the legs 49 and 50 of the bows 45 and 46 is in turn provided with a slot in which the small transmission rollers 53 are received. The long leg 49 is provided with a closed slot 54, the length of which is slightly greater than the greatest distance between the top and bottom parts of the drive chains 47 and 48, while the short leg 50 is provided with an open slot 55 which lies parallel to the slot 54, is situated next to that part of the drive chains 47 and 48 which moves in the extraction direction, and is open towards that part of the drive chains 47 and 48 which moves oppositely to the extraction direction, the drive chains engaging by one of their small transmission rollers 53 in the closed slot 54 and by the other roller in the open slot 55.

On the movement of the drive chains 47 and 48 the extraction carriages 12 and 13 are driven with the aid of the small transmission rollers 53, the slots 54 and 55, and the bows 45 and 46. At the moment when this transmission is loaded, that is to say during the extraction movement of the pile wires, the bows 45 and 46 are loaded symmetrically because the two transmission rollers 53 of each drive chain then engage in a slot 54, 55.

Because of the positioning of the chain tensioners 52, an extraction carriage will travel the distance X to Y (see also FIG. 3) more quickly than the distance Y to X. This difference in time makes it possible to eliminate the "overstroke", that is to say the difference between the length of a pile wire and the distance over which a pile wire is extracted, or the "overstroke" time is practically completely eliminated since the above mentioned difference in time can be used for them. The drive chains 47 and 48 are driven with the appropriate transmission ratio by the main shaft of the loom.

It is obvious that the extraction carriages 12 and 13 can also be driven by means of a cable or belt system controlled by a cam or rod mechanism, without departing from the principle of the invention. On the other hand it is also clear that the number of extraction carriages 12 or 13 is not a limitation for the present invention. Two extraction carriages are the most obvious solution from the technical point of view. A system having one extraction carriage, which makes the extraction movement over the number of weft cycles corresponding to the method according to the invention and then returns at a considerably higher speed for the extraction of the next pile wire, is less appropriate but is not inconceivable. A system having more than two extraction carriages on the other hand is also not unimaginable.

The insertion carriage 14 need not be further described because it need not differ from conventional pile wire carriages.

On the inclined gripper base plate 43 and 44 of the extraction carriages 12 and 13 respectively a gripper 56 (FIGS. 10 and 12) is provided, which grips fast the head 40 of a pile wire 8 (FIG. 11) in the position X, holds it fast during the extraction movement X→Y, and releases the pile wire head 40 again at the position Y (FIG. 3). The gripper 56 (FIG. 10) consists for example of a slidable jaw 58 which, held between four guide blocks 59, is slidable between a front and a rear position (FIGS. 10 and 12 respectively), and a rotatable jaw 60 which turns on a pivot point 61 and is provided with a slot 62 in which is mounted a pin 63 connected to the slidable jaw 58.

The rotatable jaw 60 is so shaped and so positioned that the top 65 of said rotatable jaw 60 comes to lie against the top 64 of the slidable jaw 58 when the two jaws 58 and and 60 are in their foremost position (FIG. 10). The slot 62 and the pin 63 are so positioned that the slidable jaw 58 closes the rotatable jaw 60 during its movement in the forward direction (see FIG. 10) and opens it during its movement towards the rear (see FIG. 12). The slidable jaw 58 is pulled forward by a spring 66, which in FIGS. 10 and 12 is disposed underneath it, and is pulled towards the rear by one or more linear cams disposed along the fixed pile wire bar 15, for example level with position Y, and which act on a cam follower 67 provided on the slidable jaw 58. In order to secure the slidable jaw 58 in its rearmost position during the return movement Y→X of an extraction carriage 12 or 13, so that the gripper 56 of the other extraction carriage 13 or 12, which at that moment is extracting a pile wire, can pass, the gripper 56 is provided with locking means. The locking means consist of a catch 68 rotatable on a pin 69 and pulled by a spring 70 against or behind a pin 71 on the slidable jaw 58. In the foremost position of the slidable jaw 58 the catch 68 rests against the side edge of the pin 71, while in its rearmost position the catch 68 is hooked behind the pin 71, so that the slidable jaw 58 is secured in position.

At the moment when the gripper 56 must take hold of a pile wire head 40 (position X), the catch 68 strikes against a stop so that, against the action of the spring 70, it moves back and releases the pin 71, so that the slidable jaw 58 slides forward through the action of the spring 66 and, during its movement, carries with it the rotatable jaw 60 by means of the slot 62 and the pin 63, so that the gripper 56 is held fast on the pile wire head 40 (FIG. 11). At the moment when the gripper 56 must release the pile wire head 40, the cam follower 67 strikes against a linear cam, so that the slidable jaw 58 is pulled back and the rotatable jaw 60 is turned towards the rear. The catch 68 engages again behind the pin 71 and the gripper 56 is locked open. The two grippers 56 are shown in broken lines in their foremost position in the section in FIG. 9.

The grippers described above are of great importance in the application of the method according to the invention, because they permit the use of a pile wire extraction and insertion system having separate extraction carriages and insertion carriages.

I claim:

1. Method for weaving pile fabrics by means of pile wire looms, wherein the fabric has a pile loop every n wefts, n being greater than or equal to 2, and wherein pile wires are each inserted into a shed in an insertion cycle which occurs during one weft cycle and are each extracted from the shed, one after the other, in an extraction cycle, characterized in that an extraction cycle takes place over n succesive weft cycles and that the insertion cycle of one pile wire takes place during an extraction cycle of another pile wire.

2. Method according to claim 1, further characterized in that there is more than one extraction cycle, wherein the extraction cycles follow one another immediately and each takes place over n successive weft cycles.

3. An apparatus for the insertion and extraction of pile wires in the weaving of pile fabrics by means of a pile wire loom, wherein the fabric has a pile loop every n wefts, n being greater than or equal to 2, consisting of:

means for guiding the insertion into a shed and extraction from the shed of pile wires in the weaving of pile fabrics; and pile wire carriages which move to-and-fro along the guide means and insert or extract the pile wires, characterized in that the pile wire carriages comprise at least one extraction carriage, wherein the extraction carriage has a means for making a extraction movement over n successive weft cycles, and at least one insertion carriage, wherein the insertion carriage has a means for making an insertion movement over one weft cycle and during the extraction movement of the extraction carriage.

4. Apparatus according to claim 3, characterized in that the pile wire carriages comprise in addition to the insertion carriages two or more extraction carriages.

5. Apparatus according to claim 4, characterized in that the extraction carriages have driving means for driving the extraction carriages in such a manner that they make the actual extraction movement more quickly than a return movement.

6. Pile wire loom provided with an apparatus according to claim 3.

7. Apparatus for the insertion into a shed and extraction from the shed of pile wires in the weaving of pile fabrics by means of a pile wire loom, consisting of means for guiding the insertion and extraction of pile wires in the weaving of pile fabrics and one or more pile wire carriages which move to-and-fro along the guide means and insert or extract the pile wires, characterized in that the guide means consist of a fixed guide track which is situated at an extraction position, coinciding with a direction of extraction of the pile wires, and a movable guide track having a means for moving the movable guide track between an insertion position with a determined pile wire insertion direction and an extraction position coinciding with the direction of extraction of the pile wires.

8. Apparatus according to claim 7, characterized in that the fixed track and the movable guide track are provided with projections and non-projection areas, the non-projection areas in one of them matching the projections of the other in order to form one guide track when the movable guide track moves to the extraction position and the fixed guide track and the movable guide track come to lie with mutually facing longitudinal sides one against the other.

9. Apparatus according to claim 8, characterized in that the fixed guide track and the movable guide track are each provided on their mutually facing longitudinal sides with a movable side wall.

10. Apparatus according to claim 9, further characterized in that the movable side wall of the movable guide track is provided with a means for opening the movable side wall before or during the movement of the movable guide track to the extraction position and for closing the movable side wall of the movable guide track when the two guide tracks come to lie one in the other, at which moment the movable side wall of the fixed guide track, which is also provided with a means for opening and closing during or after the movement of the movable guide track to the insertion position.

11. Apparatus according to claim 10, further characterized in that the movable side walls of the guide tracks consist of hooks having legs and which are installed at a height of the projections of the guide tracks, and on which one leg forms the movable side walls of the guide tracks while the other leg is rotatable about a pin disposed parallel to the guide tracks.

12. Pile wire loom provided with an apparatus according to claim 6.

13. An apparatus for the insertion and extraction of pile wires in the weaving of pile fabrics by means of a pile wire loom, consisting of:

guide means for guiding the insertion into a shed and extraction from the shed of pile wires in the weaving of pile fabrics;

at least one pile wire carriage which moves to-and-fro along the guide means and which inserts or extracts the pile wires;

wherein the pile wire carrier is provided with a gripper having a slidable jaw and a rotatable jaw, wherein the slidable jaw is provided with a cam follower, and wherein the rotatable jaw turns about a pin connected to the pile wire carrier and is connected to the slidable jaw by means of a slot and pin transmission in such a manner that the rotatable jaw turns towards the slidable jaw when the latter moves in the direction of the guide means and that the rotatable jaw turns away from the slidable jaw when the latter moves in an opposite direction; and wherein the gripper is further provided with one or more cams which are disposed along the guide means and are so shaped so that the gripper closes during its movement towards the guide means and in the closed position can grip a pile wire, and which opens during its movement away from the guide means.

14. Apparatus according to claim 13, characterized in that a spring is disposed between the pile wire carriage and the slidable jaw.

15. Apparatus according to claim 14, characterized in that the pile wire carriage is provided with a movable catch whose return movement is effected by a spring, in that the slidable jaw is provided with a pin behind which the catch is hooked at the moment when the slidable jaw is situated in the position at the end of the direction opposite to the action of the spring, so that the slidable jaw is made fast, and in that along the guide means one or more stops are provided which move the catch on the passage of the pile wire carriage, in such a manner that the slidable jaw is released and subjected to the action of the spring.

16. Pile wire loom provided with an apparatus according to claim 13.

* * * * *